United States Patent [19]

Hanyu

[11] 4,343,252

[45] Aug. 10, 1982

[54] FREE ARM SEWING MACHINE

[75] Inventor: Susumu Hanyu, Hachioji, Japan

[73] Assignee: Janome Sewing Machine Co. Ltd., Tokyo, Japan

[21] Appl. No.: 123,793

[22] Filed: Feb. 22, 1980

[30] Foreign Application Priority Data

Feb. 27, 1979 [JP] Japan ..... 54/21302

[51] Int. Cl.[3] ..... D05B 75/00

[52] U.S. Cl. ..... 112/258; 248/185; 248/397

[58] Field of Search ..... 112/258, 259, 260, 217.1; 248/371, 397, 185

[56] References Cited

U.S. PATENT DOCUMENTS 2,460,828 2/1949 Ivandick ..... 112/258

4,036,158 7/1977 Fresard et al. ..... 112/258

4,080,913 3/1978 Arendash et al. ..... 112/258

FOREIGN PATENT DOCUMENTS 916925 7/1954 Fed. Rep. of Germany ..... 112/258

*Primary Examiner*—Peter P. Nerbun

*Attorney, Agent, or Firm*—Michael J. Striker

[57] ABSTRACT

A free arm sewing machine is provided with a manually operated arrangement for positioning and holding the sewing machine body relative to its base. This arrangement comprises a transverse shaft turnable in the base of the sewing machine, an operating dial secured to the shaft and a disc also secured to the shaft and having a pin engageable with a groove formed in the free arm of the sewing machine.

3 Claims, 13 Drawing Figures

FREE ARM SEWING MACHINE

BACKGROUND OF THE INVENTION

The invention relates to a sewing machine, and more particularly relates to a free arm sewing machine. A sewing machine body is connected to a base by a pivot structure, and a positioning device is provided to change the sewing machine into a flat bed working condition and into a free arm working condition. The invention also relates to a free arm sewing machine which is modified to provide a lower machine bed, on which the sewing work is performed, especially when the sewing machine is used as a flat bed sewing machine when is so frequently employed. In fact, the machine bed of the sewing machine is lowered in such a degree that the underside at the end of the free arm contacts the upper face of a table on which the sewing machine is placed, for the purpose of providing an efficient sewing work to the machine operator.

Generally a free arm sewing machine, which may be used as a flat bed sewing machine by employing an auxiliary bed plate, has a free arm 1 which is spaced (clearance C) from the lower machine base 2 as shown in FIG. 1, so that a fabric to be sewn may be inserted over the free arm. This type of the sewing machine requires at least the height $H_1$ from the upper face of the table S to the sewing work face 3*a* of the sewing machine as shown in FIGS. 1 and 2. The reference numeral 3 denotes an auxiliary bed plate which is employed when the sewing machine is used as a flat bed sewing machine. The auxiliary bed plate 3 is removed when the sewing machine is used as a free arm sewing machine, and may be used as a case for accommodating the accessories of the sewing machine. In case a sewing operation is performed by a sewing machine placed on a table, it can be said that a more efficient and smoother sewing operation is possible if the physical working level of the sewing machine is lowered. The tables generally available on the market are so designed and standardized as to be most suitable for working thereon. It is, therefore, apparent that the sewing work efficiency is so lessened if the sewing machine with the working level H is placed on the table. The most suitable height or level of the table is such that the elbows of the operator lightly touch the upper face S of the table.

FIG. 2 shows a stitching operation with a sewing machine as shown in FIG. 1 which is placed on the table S as abovementioned. In this case, since the working level of the sewing machine is $H_1$, the machine operator must raise the hands to the level $H_1$ from the elbow.

FIG. 3 shows a sewing machine in which the base 4 is lowered partly on the side of the free arm 5. In this case, the working level $H_2$ is lower than that of the sewing machine in FIG. 1. Instead, the sewing machine in FIG. 3 is structurally unstable. It becomes, therefore, necessary to provide an auxiliary foot 6 as shown. By the way, the reference numeral 7 denotes an auxiliary table plate of the same function as that 3 in FIG. 1.

As well known, the free arm sewing machine requires at least the vertical thickness of the free arm and an additional clearance between the free arm and the upper face of the table for inserting a sewn fabric over the free arm. The sewing machine of the type, however, is normally used as a flat bed sewing machine, and is not so often as a free arm sewing machine. It is, therefore, important to design the working level of the sewing machine on the side of the flat bed sewing machine.

SUMMARY OF THE INVENTION

This invention has been provided to eliminate the defects and disadvantages of the prior art.

It is a primary object of the invention to easily change a sewing machine to a free arm working condition from a flat bed working condition, and vice versa.

It is another object of the invention to provide a sewing machine which is efficient and convenient in the free arm working condition as well as in the flat bed working condition.

The other features and advantages of the invention will be apparent from the following description of the preferred embodiments in reference to the attached drawings.

Figure 1:
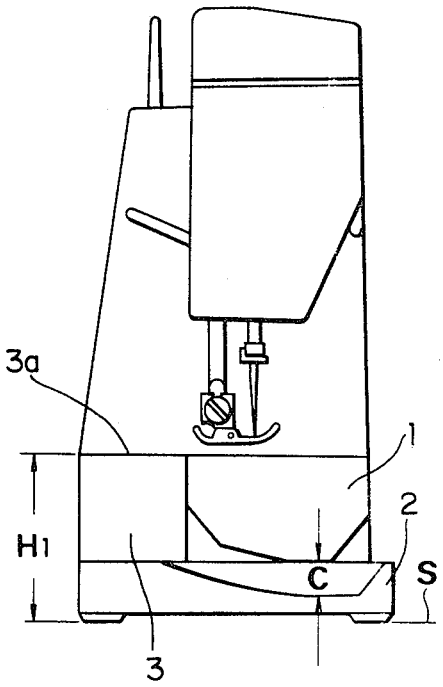
FIG. 1 PRIOR ART
FIG. 1 is a side elevational view of a conventional free arm sewing machine.
Figure 3:
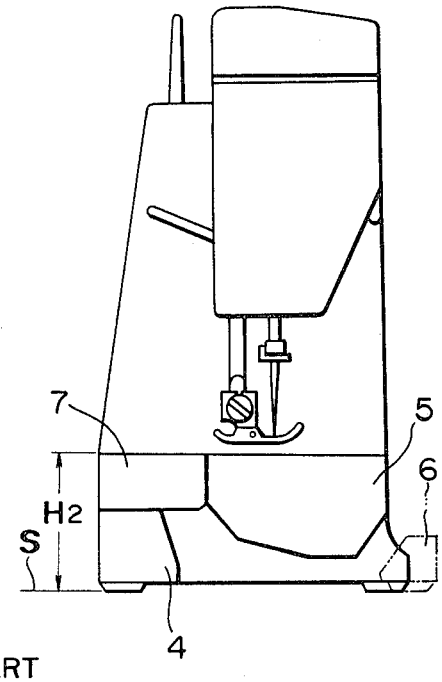
FIG. 3 PRIOR ART
FIG. 3 is a side elevational view of another conventional free arm sewing machine.

DETAILED DESCRIPTION OF THE PREFERRED EMBODIMENTS:

In reference to FIGS. 4–7, the reference numeral 10 denotes a sewing machine body supported by a base 9. The sewing machine body 10 with the stitch forming instrumentalities is connected to the base 9 by a pivot structure 8. The sewing machine body 10 is of a free arm type. As well, known the free arm 12 provides a limited region of working place. An auxiliary plate 14 id detachably mounted to the sewing machine to provide broader region of working place together with the free arm 12. The auxiliary plate 14 may be used as a case for accommodating the accessories of the sewing machine.

Figure 4:
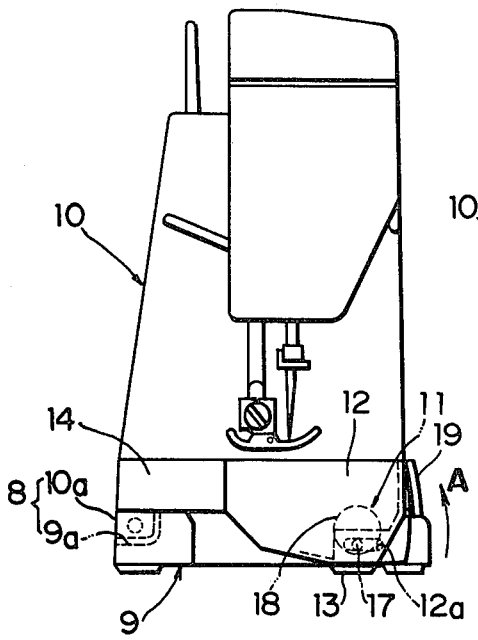
FIG. 4 is a side elevational view of a free arm sewing machine of the invention shown in a flat bed working condition.
Figure 5:
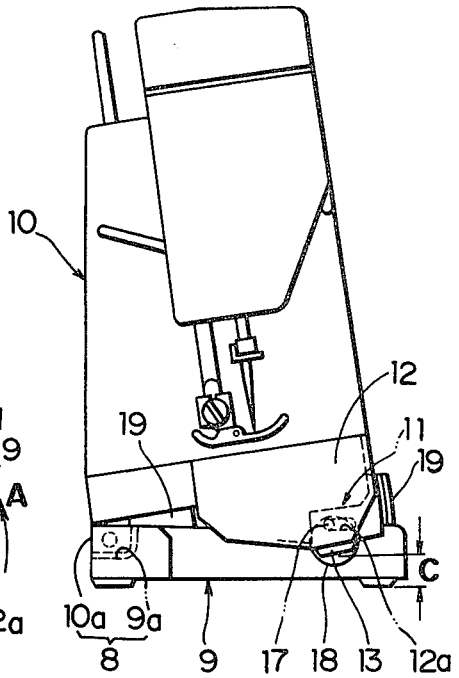
FIG. 5 is a side elevational view of the invention shown in a free arm working condition.
Figure 6:
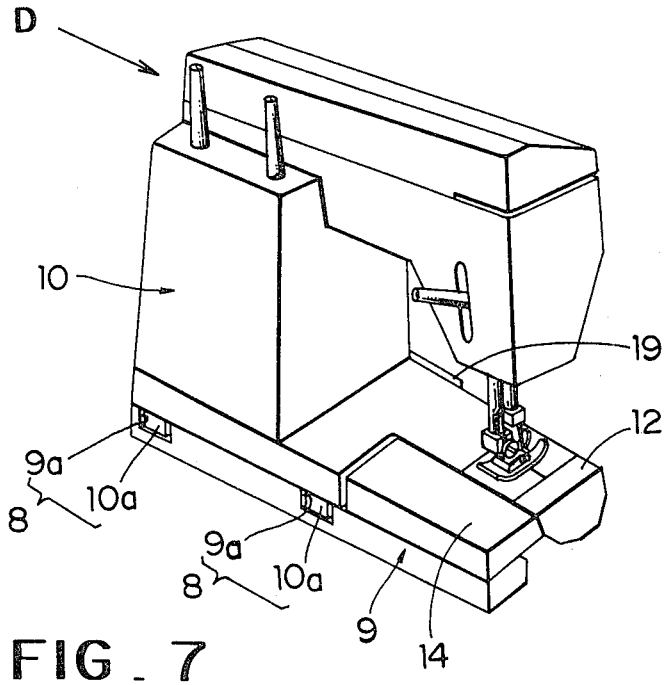
FIG. 6 is a rear perspective view of the free arm sewing machine of the invention shown in a flat bed working condition.
Figure 7:
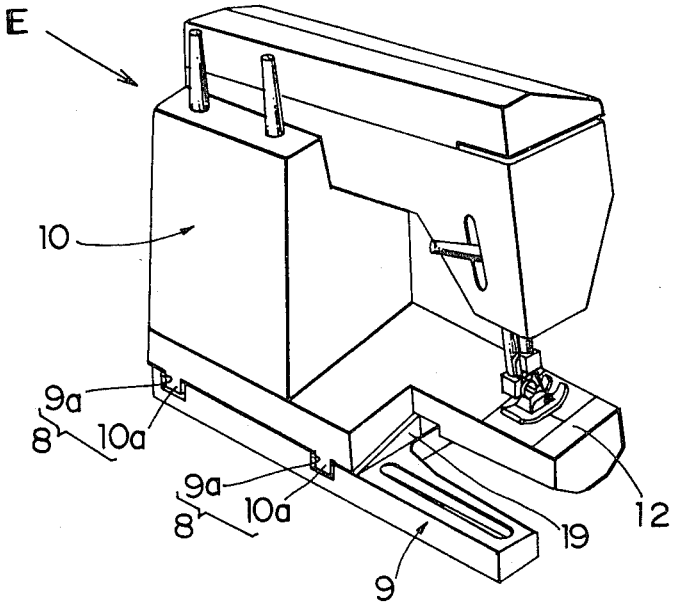
FIG. 7 is a rear perspective view of the free arm sewing machine of the invention shown in a free arm working condition.

The reference numeral 11 denotes a positioning device for suitably holding the sewing machine body 10 in the flat bed condition with respect to the base 9 as shown in FIGS. 4 and 6, or in the free arm condition as shown in FIG. 7. The sewing work face level of the sewing machine in the flat bed condition is structurally made to a minimum size when the sewing machine is placed on a standard table generally available on the market which, is different in the height from the conventional sewing machine table. A rubber foot 13 secured to the underside of a free arm 12 helps holding the sewing machine in a stabilized condition in the flat bed condition which is more frequently employed by the machine operator. When a sewing operation is made in the free arm condition which is not so often employed, the sewing machine body 10 is turned around the pivot structure 8 in the counterclockwise direction relative to the base 9 as shown in FIGS. 5 and 7, and the sewing machine body 10 is fixed in a predetermined angular position by the positioning device 11 in such a manner that a clearance C is provided between the underside of the foot 13 of the free arm 12 and the upper face of the table, so that a fabric to be sewn may be inserted therebetween.

Figure 8:
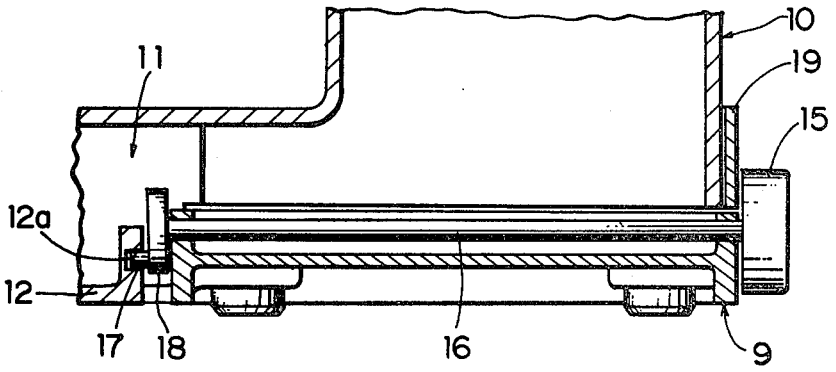
FIG. 8 is a front elevational view of a positioning device of the invention.
Figure 9:
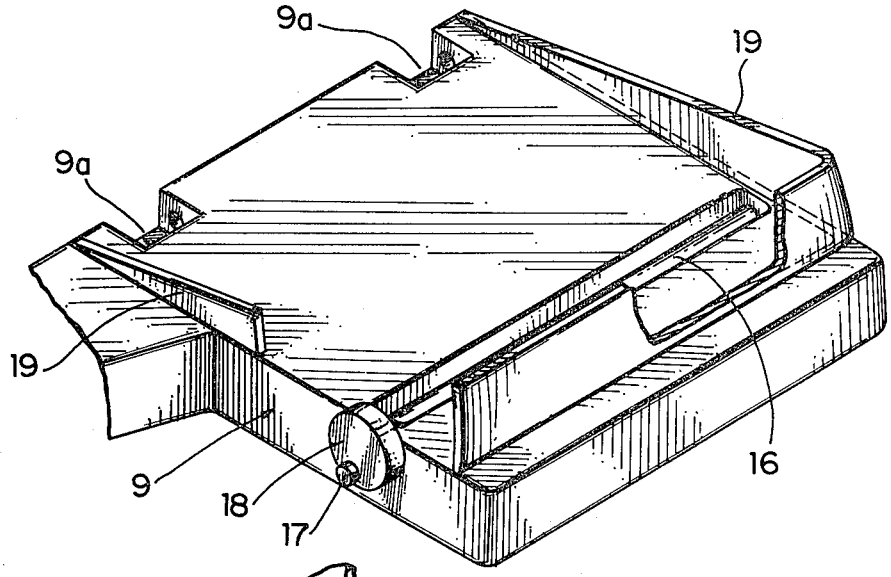
FIG. 9 is a perspective view of a main part of a base of the free arm sewing machine of the invention.
Figure 10:
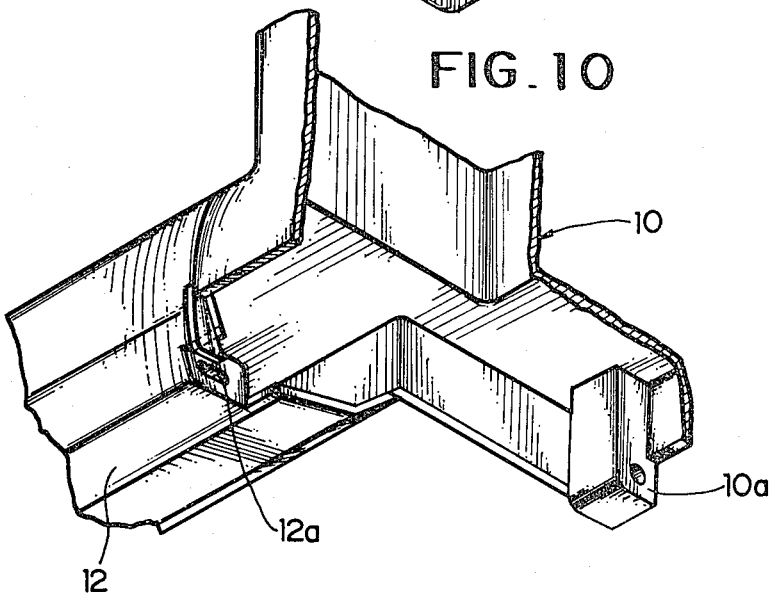
FIG. 10 is a perspective view of a part of the free arm sewing machine of the invention.

In reference to FIGS. 8–10, the positioning device 11 is now explained. A reference numeral 15 is a changeover dial which is secured to one end of a transverse shaft 16 turnably mounted in the base 9 at the forward part thereof. The transverse shaft 16 has a disc 18 secured to the other end thereof. The disc 18 has a pin 17 secured to one side thereof at a position spaced from the central axis thereof. The pin 17 is inserted into a groove 12*a* formed in a part of the free arm 12. A reference numeral 19 is a cover plate which is secured to the base 9 and partly covers the lower portion of the sewing machine body 10. On the rear end part of the base 9 opposite to the transverse shaft 16, a pair of transversely spaced and recessed seats 9*a* are provided. The pair of recessed seats 9*a* are engaged by a pair of transversely spaced projections 10*a* formed on the rear end part of the sewing machine body 10. Then the machine body 10 is turnably connected to the base 9 by a transverse shaft (not shown) passing through the pair of recessed seats 9*a* of the base 9 and the pair of projections 10*a* of the sewing machine body 10 as shown in FIG. 6. A spring, though it is not shown, is provided to bias the sewing machine body 10 in the counterclockwise direction around the pivot structure 8 as indicated by an arrow mark A in FIG. 4.

Figure 11:
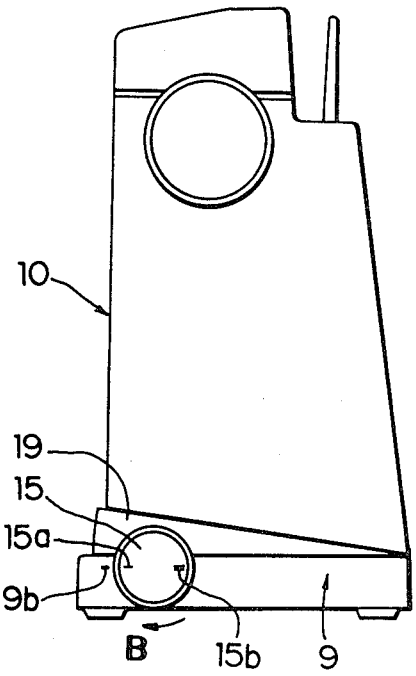
FIG. 11 is a side elevational view of the sewing machine of the invention seen from the direction D in FIG. 6.

In the flat bed condition, as shown in FIG. 4, the pin 17 on the disc 18 engages the groove 12*a* of the free arm 12 at the lowest position thereof, thereby to hold the sewing machine body 10 on the base 9 in such a manner that the upper face of the free arm 12 is horizontal. In this condition, the spring force around the pivot structure 8 in the direction indicated by the arrow mark A is applied to the pin 17. However, the rotational force of the spring is not applied to the disc 18, because the direction of the spring force A intersects the movable direction of the pin 17. Further in this condition, as shown in FIG. 11, a mark 15*a* on the dial 15 indicating the flat bed condition is in alignment with a reference mark 9*b* fixedly provided on the base 9. Thus the free arm 12 is held in this condition in a stabilized manner the inner face of the dial 15 is so structured as to stoppingly rotate in cooperation with the opposite structure of the base 9.

Figure 2:
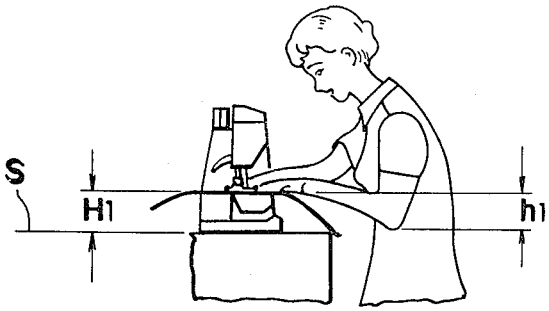
PRIOR ART FIG. 2
FIG. 2 is a side elevational view of an actual working condition of the sewing machine.
Figure 12:
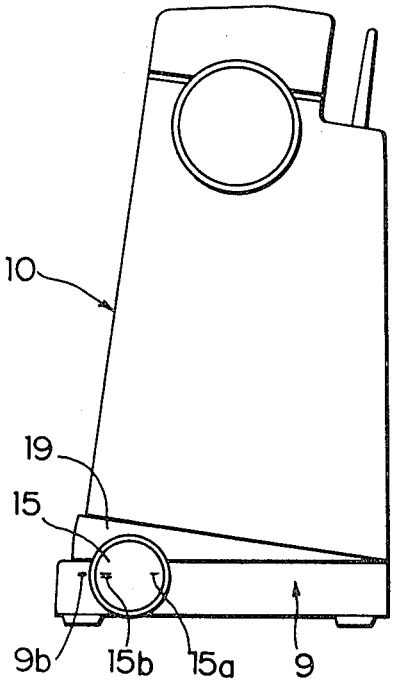
FIG. 12 is a side elevational view of the sewing machine of the invention seen from the direction E in FIG. 7.

The changeover from the flat bed condition as shown in FIGS. 4 and 6 to the free arm condition as shown in FIGS. 5 and 7 is as follows: The dial 15 is manually rotated about 180°, in addition to the spring force A in FIG. 4, in the direction indicated by an arrow mark B as shown in FIG. 11 until a mark 15*b* on the dial indicating the free arm condition comes into alignment with the reference mark 9*b* on the base 9 as shown in FIG. 12, and then the dial 15 is held in this position. Accordingly the disc 18 on the transverse shaft 16 displaces from the lowest position to the highest position as shown in FIG. 5. As a result, the sewing machine body 10 is turned around the pivot structure 8 to a position as shown in FIGS. 5, 7 and 12 and there the sewing machine body 10 is held in a stabilized condition. In this condition, a clearance C is provided between the underside of the free arm 12 and the upper face of the table on which the sewing machine is placed, the clearance C being sufficient to insert a fabric to be sewn over the free arm 12, thereby to enable the machine operator to do the free arm sewing operation. In this free arm condition, the upper faces of the free arm 12 is rearwardly inclined from the machine operator and becomes higher toward the machine operator. Actually as the operator's eyes are, however, in a considerably high position as shown in FIG. 2, the inclination of the free arm 12 will give no inconvenience to the sewing operation.

Figure 13:
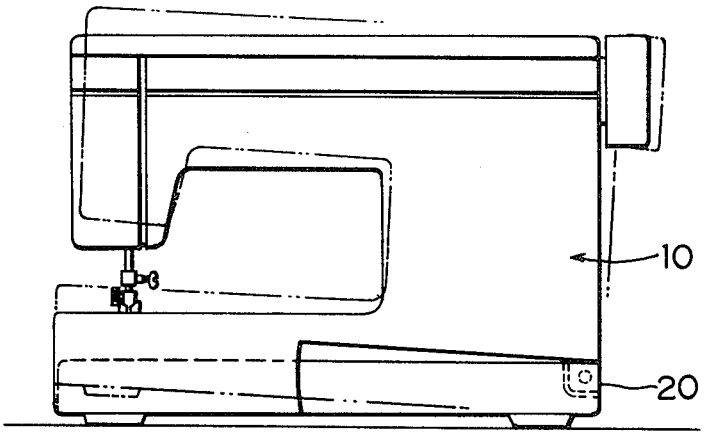
FIG. 13 is a front elevational view of another embodiment of the invention.

FIG. 13 shows another embodiment of the invention, in which a pivot structure 20 is provided on the right side end of the sewing machine in the front elevational view of the sewing machine. Namely, the pivot structure 10 is provided between the right lower end of the standard and the right upper end of the base. By providing a proper positioning device, the sewing machine body 10 with the free arm is displaced around the pivot structure 20 to the position indicated by the imaginary line from the position indicated by the solid line. Thus the sewing machine body 10 is held in the inclined condition with a suitable clearance between the underside of the free arm and the upper face of the table on which the sewing machine is placed.

It will be understood that each of the elements described above, or two or more together, may also find a useful application in other types of free arm sewing machines differing from the types described above.

While the invention has been illustrated and described as embodied in a free arm sewing machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A free arm sewing machine, comprising a sewing machine body having stitch forming instrumentalities; a base for supporting the sewing machine body; pivot means turnably connecting the sewing machine body to the base; and positioning means manually operated to displace the sewing machine body relative to the base and to hold the sewing machine body in a predetermined position, said positioning means including a transverse shaft turnably arranged in said base, an operating dial secured to one end of the transverse shaft, a disc secured to the other end of the transverse shaft and having a pin secured to one side thereof, and a groove formed in a part of the free arm and being in engagement with the pin.

2. A free arm sewing machine as defined in claim 1, wherein said pivot means is provided on the rear side of the sewing machine.

3. A free arm sewing machine as defined in claim 1, wherein said pivot means is provided on one flank side of the sewing machine.

* * * * *